US007383961B2

(12) United States Patent
Daugherty, Jr.

(10) Patent No.: US 7,383,961 B2
(45) Date of Patent: Jun. 10, 2008

(54) TAPER LUGS ON DRAFT GEAR PLATES

(75) Inventor: David W. Daugherty, Jr., Crown Point, IN (US)

(73) Assignee: WABTEC Holding Corp., Wilmerding, PA (US)

( * ) Notice: Subject to any disclaimer, the term of this patent is extended or adjusted under 35 U.S.C. 154(b) by 232 days.

(21) Appl. No.: 11/071,003

(22) Filed: Mar. 3, 2005

(65) Prior Publication Data

US 2005/0252873 A1 Nov. 17, 2005

Related U.S. Application Data

(60) Provisional application No. 60/561,048, filed on Apr. 8, 2004.

(51) Int. Cl.
*B61G 9/00* (2006.01)

(52) U.S. Cl. ..... 213/22

(58) Field of Classification Search ..... 213/7, 213/22, 23, 24, 29

See application file for complete search history.

(56) References Cited

U.S. PATENT DOCUMENTS 4,645,187 A * 2/1987 Kanjo et al. ..... 267/202

4,735,328 A 4/1988 Carlstedt

OTHER PUBLICATIONS

PCT International Search Report, PCT International Appl. No. PCT/US2005/011498.

Notification of Transmittal of the International Search Report and the Written Opinion of the International Searching Authority, or the Declaration.

* cited by examiner

*Primary Examiner*—S. Joseph Morano
*Assistant Examiner*—Robert J McCarry, Jr.
(74) *Attorney, Agent, or Firm*—James Ray & Assoc.

(57) ABSTRACT

The present invention increases the capacity and resistance to closure of the draft gear assembly wherein a portion of the lug supporting plates, usually the tapered plates, within the friction cushioning device is tapered or angled to increase the side force on the movable plates which increases the draft gear assembly's resistance to closure and increases the capacity of the draft gear assembly. Additionally or alternatively a tapered or angled top surface on the housing's third horizontal rib may be provided in the area that contacts or supports the bottom surfaces of the tapered plates. Providing a taper on the third horizontal lug which mates or cooperates with an angle on the bottom edge surface of the tapered plates increases the side force on the movable plates during the application of a buffing shock to the draft gear assembly.

18 Claims, 4 Drawing Sheets

TAPER LUGS ON DRAFT GEAR PLATES

CROSS-REFERENCE TO RELATED APPLICATIONS

This application claims priority from provisional application Ser. No. 60/561,048, filed Apr. 8, 2004. This application is also closely related to U.S. patent application Ser. No. 11/071,004, entitled "Taper Under Taper Plate to Increase Side Force On The Movable Plate"

FIELD OF THE INVENTION

The present invention relates, in general, to draft gear assemblies for use in cushioning both buff and draft shocks normally encountered by railway rolling stock during make-up and operation of a train consist on a track structure and, more particularly, the present invention relates to a draft gear assembly having plates, particularly the tapered plates, wherein a portion of a lugs supporting the plates is tapered or angled to increase the side force from the wedge shoe to the movable plate which, in turn, increases the draft gear assembly's resistance to closure and increases the capacity of the draft gear assembly.

BACKGROUND OF THE INVENTION

Draft gear assemblies which utilize friction-type clutch mechanisms to absorb heat energy generated during service have been in widespread use in the railroad industry for many years to absorb both buff and draft shocks applied to the railway rolling stock. Many of such draft gear assemblies which were in use, prior to the present invention, are taught in U.S. Pat. Nos. 2,916,163; 3,178,036; 3,447,693; and 4,645,187. Each of the above-identified patents is owned by the assignee of the present invention. The teachings of each of these patents are all incorporated into the present application by reference thereto.

These draft gear assemblies are designed to receive coupler forces and dissipate them without damage to the car structure and lading. The assemblies are disposed within an elongated opening located in the center sill member of the railway car along the longitudinal axis thereof and behind the shank, or innermost end, of the railway car's coupling mechanism. In this position, these friction clutch type draft gear assemblies will absorb at least a relatively large portion of both the buff and draft forces generated during service. Such buff and draft forces encountered by such railway cars are usually being applied in an alternating manner to the center sill member during normal car operation on the track.

It is well recognized in the art that these draft gear assemblies must be provided with the capability of maintaining at least a certain minimum shock absorbing capacity both during making up a train consist and in-track service. Such minimum capacity has been specified by the Association of American Railroads (AAR) and is defined in the standards issued by the AAR. For example, friction clutch type draft gear assemblies have a specified absolute minimum capacity rating of at least 36,000 foot pounds. Any draft gear assembly with a capacity rating which is determined to be below 36,000 pounds will not receive approval from the AAR for service on any railroad car which may be used in interchange.

It is, likewise, important to note that the heat energy absorbing action of the friction clutch mechanism must enable this minimum capacity rating to be readily achieved without exceeding a specified maximum 500,000 pound reaction force, or pressure, being exerted on the center sill member of the railway car during both such make-up and operation of such train consist. It has been found that such maximum reaction pressure is required to enable these high energy shocks to be readily absorbed without upsetting the end of the coupling member shank and/or damaging other critical car components and/or lading that is being transported by such railway car.

In order for the manufacturers of such friction clutch type draft gear assemblies to meet the requirements of the railroad industry, with the ever increasing load carrying capacity of their modern day railroad cars, it has become of extreme importance to enhance the overall rated capacity of the friction-type draft gear assemblies as much as possible. This higher capacity rating being found necessary in order to minimize any damage to such cars and/or the lading due to the increased forces being exerted on the center sill member of the cars by the heavier loads such cars are now carrying.

SUMMARY OF THE INVENTION

It is therefore an object of the invention to produce a draft gear assembly having an increased capacity and resistance to closure.

It is a further object of the invention to provide a draft gear assembly wherein an additional side force is applied to the movable plates from the tapered plate.

It is still yet a further object of the invention to provide the lugs supporting the tapered plate with a tapered portion to increase the side force on the movable plate which increases the draft gear assembly's resistance to closure and increases the capacity of the draft gear assembly.

It is still yet a further object of the invention to provide a draft gear assembly wherein an angle is provided on the portion of the lug supporting the tapered plate which cooperatively contacts the third housing rib so as to increase the side force on the movable plate, increasing the capacity of the draft gear and providing a greater resistance to closure.

It is yet a further object of the invention to provide a draft gear assembly having tapered plates wherein a portion of a horizontal housing rib supporting the lugs of the tapered plates is tapered or angled to increase the side force on the movable plate which increases the draft gear assembly's resistance to closure and increases the capacity of the draft gear assembly.

It is an additional object of the invention to provide tapered lugs supporting plates in split wedge draft gears in order to increase the side force from the friction wedge means to the friction plate which increases the draft gear assembly's resistance to closure and increases the capacity of the draft gear assembly.

Briefly, and in accordance with the forgoing objects, the invention comprises a draft gear assembly comprising a housing closed at one end and open at the opposed end and having a rear portion adjacent the closed end and a front portion adjacent the open end, a compressible cushioning element centrally disposed within the rear portion abutting the housing end and extending longitudinally there from, a seat means abutting the opposite end of the compressible cushioning element during application and release of a force on the draft gear assembly, and a friction cushioning means positioned at least partially within said front portion of said housing for absorbing energy during a compression of said draft gear assembly. The friction cushioning means includes a pair of laterally spaced outer stationary plates having an outer surface for engaging the housing and an opposed inner friction surface, a pair of laterally spaced movable plates having an outer friction surface for movably engaging the outer stationary plates, an inner friction surface and at least one substantially flat edge intermediate the outer friction and inner friction surfaces for engaging the seat means. The friction cushioning means also includes a pair of laterally spaced tapered plates having lugs for supporting the tapered plates within the housing. The lugs of the tapered plate are tapered or angled to increase the side force on the movable plate. The tapered plates have an outer friction and an inner friction surface wherein the outer friction surface movably and frictionally engages the inner friction surface of the movable plate. The friction cushioning means further includes a pair of laterally spaced wedge shoes having an outer friction surface for movably and frictionally engaging an inner friction surface of the tapered plate and a center wedge having a pair of matching predetermined tapered portions for engaging the tapered portion of the wedge shoe to initiate frictional engagement of the friction cushioning means and thereby absorb energy. The housing includes three horizontal ribs for positioning and/or holding the components of the cushioning means. A spring release means is provided which engages and longitudinally extends between the seat means and the center wedge for continuously urging the friction cushioning means outwardly from the compressible cushioning means to release the friction cushioning element when an applied force compressing the draft gear is removed.

The present invention increases the capacity and resistance to closure of the draft gear assembly wherein a portion of the lug supporting the tapered plates is tapered or angled to increase the side force on the movable plate which increases the draft gear assembly's resistance to closure and increases the capacity of the draft gear assembly. Additionally or alternatively a tapered or angled top surface on the housing's third horizontal rib may be provided in the area that contacts or supports the lugs of the tapered plates. Providing a taper on the third horizontal rib which mates or cooperates with an angle on the lugs of the tapered plates increases the side force on the movable plates during the application of a buffing shock to the draft gear assembly.

The present invention is also applicable to split wedge draft gears wherein the lugs, which support the plate means positioned on either side of the friction plate, are tapered to increase the side force transferred from the wedge means to the friction plate.

Although a number of objects and advantages of the present invention have been described in some detail above, various additional objects and advantages of the draft gear assembly of the present invention will become more readily apparent to those persons who are skilled in the art from the following more detailed description of the invention, particularly, when such detailed description of the invention is taken in conjunction with both the attached drawing figures and with the appended claims.

DETAILED DESCRIPTION OF THE INVENTION

Figure 1:
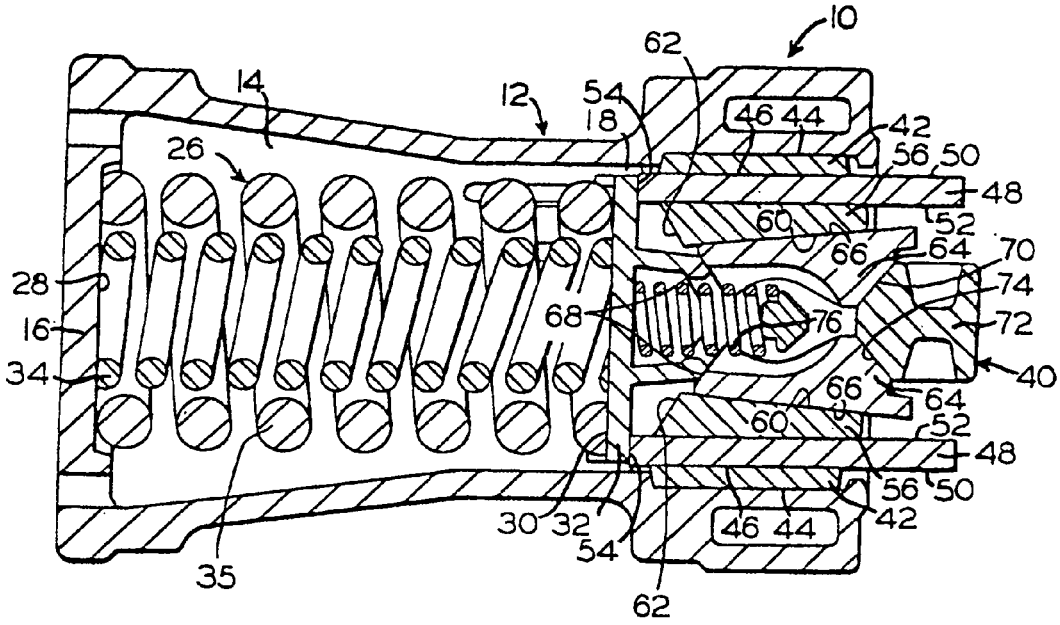
FIG. 1 is a longitudinal cross-sectional view of a draft gear assembly of the invention incorporating one form of a presently preferred embodiment of a cushioning element for the draft gear assembly.

The draft gear assembly, according to the present invention, is installed in alignment with a railroad car center sill between a front and a rear draft gear lug. A vertical yoke is connected to a coupler shank by a draft key with a coupler horn spaced from a striking plate and with a front follower member within the yoke which is positioned adjacent to the front lugs, all substantially in accordance with the prior art conventional practice as illustrated in the aforementioned U.S. Pat. No. 2,916,163.

Prior to proceeding to the more detailed description of the various embodiments of the instant invention, it should be pointed out that, for the sake of clarity, identical components which have identical functions have been identified with identical reference numerals throughout the several views that have been illustrated in the drawings.

Figure 2:
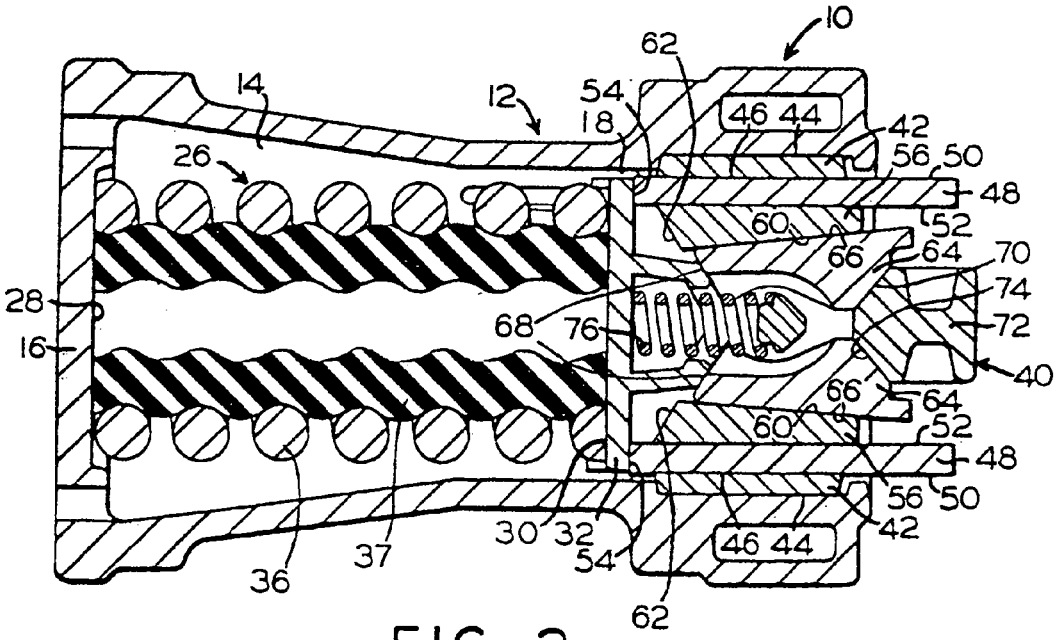
FIG. 2 is a longitudinal cross-sectional view of a draft gear assembly of the invention incorporating an alternative embodiment of a cushioning element for the draft gear assembly.
Figure 3:
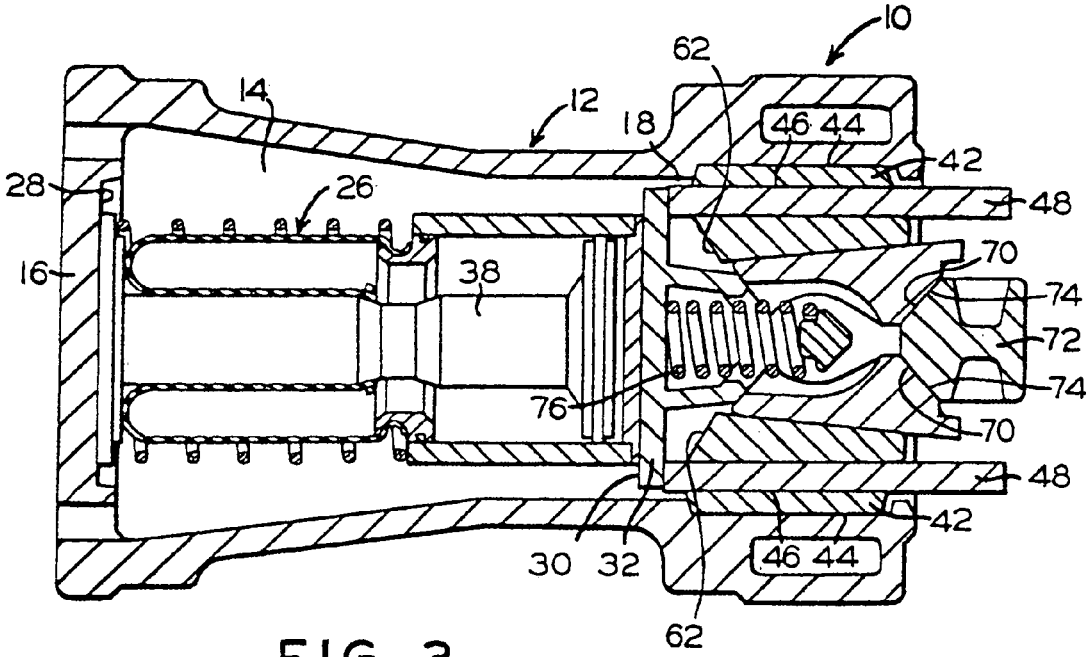
FIG. 3 is a longitudinal cross-sectional view of a draft gear assembly of the invention incorporating an alternative embodiment of a hydraulic cushioning element for the draft gear assembly.
Figure 4:
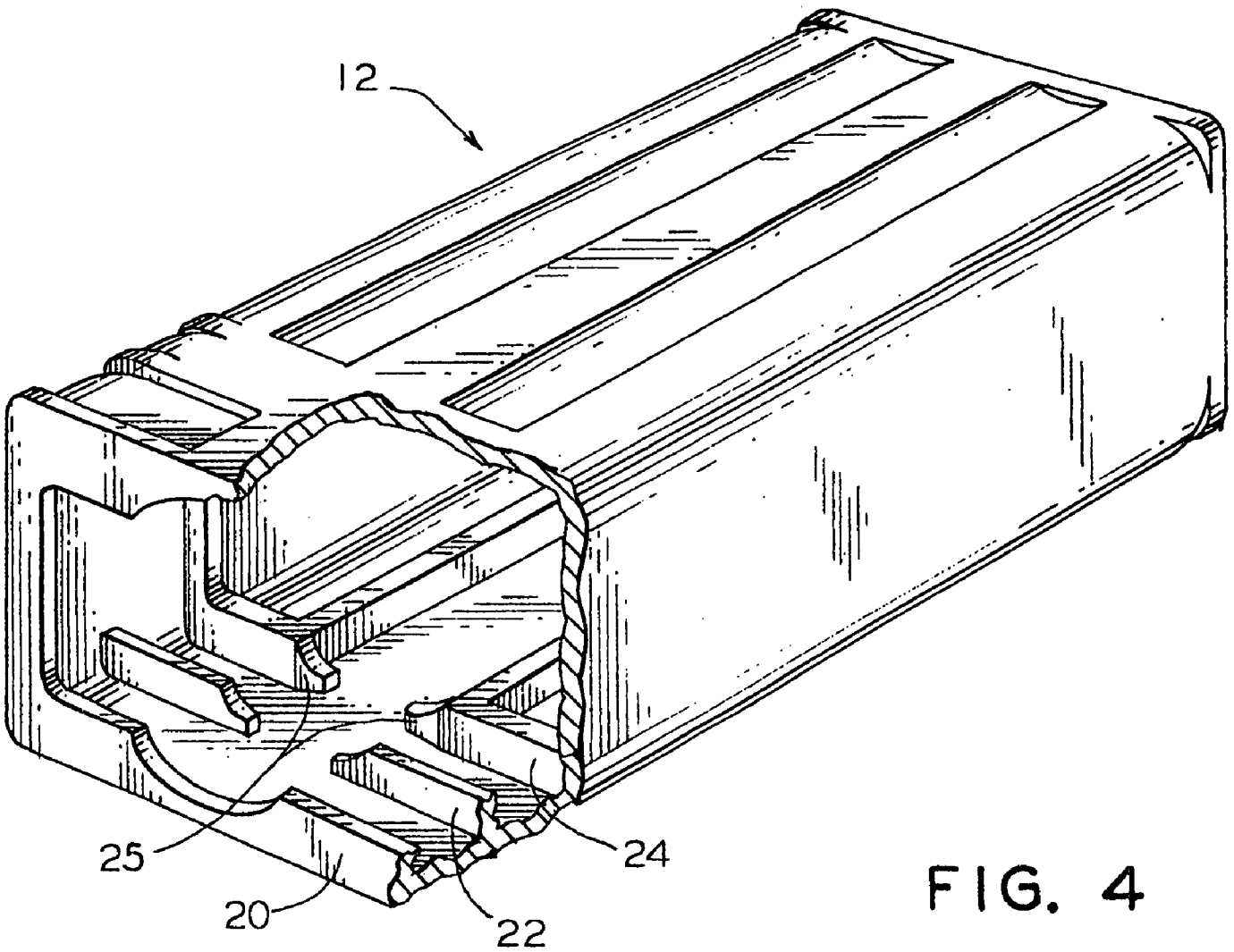
FIG. 4 is a perspective view of the draft gear housing illustrating the first, second, and third horizontal rib including the inventive tapered surface on the third rib.

Now reference is made, more particularly, to drawing FIGS. 1-4. Illustrated therein are the essential components of a draft gear assembly, generally designated 10, used in a railway car (not shown). The assembly 10 includes a housing, generally designated as 12. The housing 12 is open at one end and has a rear portion 14 adjacent a bottom wall 16 which closes the other end of housing 12. Rear portion 14 is provided for receiving therein a compressible cushioning means, generally designated as 26. Housing 12 includes a front portion 18 adjacent the open end. Front portion 18 is in open communication with the rear portion. As illustrated in FIG. 4, housing 12 additionally includes first, second, and third horizontal ribs 20, 22, and 24. The third horizontal rib 24, which supports several of the plates of the friction cushioning means 40, including lugs 63 of the tapered plates 56, has a tapered top surface 25 in the area that supports or contacts the lugs 63 of the tapered plates 56.

The compressible cushioning element 26 is centrally disposed within the rear portion 14 and has one end thereof abutting at least a portion of an inner surface 28 of the bottom wall 16 of housing 12. The compressible cushioning element 26 extends longitudinally from bottom wall 16 where the opposite end is placed into abutting relationship with at least a portion of one surface 30 of a seat means 32. Seat means 32 is positioned within the housing 12 for longitudinal movement therein for respectively compressing and releasing the compressible cushioning element 26 during application and release of a force on the draft gear assembly 10.

As shown in FIG. 1, the compressible cushioning element 26, according to one embodiment of the invention, comprises at least one and preferably at least two springs 34, 35. FIG. 2 shows an alternative embodiment for a compressible cushioning element 26 which comprises an outer coil spring 36 and an inner rubber spring 37. FIG. 3 shows another alternative embodiment of the invention in which the compressible cushioning element 26 is a hydraulic unit 38 such as taught in U.S. Pat. No. 3,447,693.

A friction cushioning means, generally designated as 40, is positioned at least partially within the front portion 18 of the housing 12. The friction cushioning means 40 absorbs energy during application of a force sufficient to cause a compression of the draft gear assembly 10.

Figure 6:
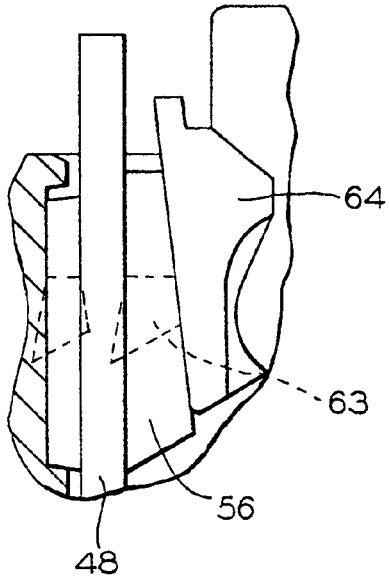
FIG. 6 shows a schematic view of the taper on the lugs of the draft gear.

The friction cushioning means 40 includes a pair of laterally spaced outer stationary plates 42 having an outer surface 44 and an opposed inner friction surface 46. The outer surface 44 engages the housing 12. A pair of laterally spaced movable plates 48 of substantially uniform thickness is also provided. Movable plates 48 have an outer friction surface 50 and an inner friction surface 52 and at least one substantially flat edge 54 intermediate the outer friction surface 50 and the inner friction surface 52 which edge 54 engages the seat means 32. At least a portion of the outer friction surface 50 movably and frictionally engages the inner friction surface 46 of the outer stationary plate 42. A pair of laterally spaced tapered plates 56 is provided. The tapered plates 56 include an outer friction surface 58 and an inner friction surface 60. The outer friction surface 58 movably and frictionally engages at least a portion of the inner friction surface 52 of the movable plate 48. As shown in FIG. 6, the tapered plates 56 include an angled or tapered lug 63 intermediate the outer friction surface 58 and the inner friction surface 60. The laterally spaced outer stationary plates 42 and the lug 63 of the tapered plates 56 sit on the third horizontal rib 24 of the housing 12. This angled or tapered lug edge 63 of the tapered plates 56 is in the area where the tapered plates 56 contact the tapered top surface 25 of the third horizontal rib 24. Friction cushioning means 40 further includes a pair of laterally spaced wedge shoes 64 which have at least a portion of an outer friction surface 66 movably and frictionally engaging at least a portion of the inner friction surface 60 of the tapered stationary plate 56. Wedge shoes 64 have at least a portion of one edge 68 engaging seat means 32 and a predetermined tapered portion 70 on an opposed edge thereof. A center wedge 72 is provided which has a pair of matching tapered portions 74 for engaging the tapered portion 70 of the wedge shoe 64 to initiate frictional engagement of the friction cushioning means 40.

It has been discovered that providing an angle or taper 25 on the top surface of the third horizontal rib 24 and correspondingly providing an angle or taper on the lug 63 of the tapered plates 56 in the area that contacts this tapered top surface 25 of the third horizontal lug 24 of the housing 12, results in a greater side force being applied to movable plates 48 by enhancing the force transfer from the wedge shoes 64 to the movable plates 48. Thus, the capacity of the draft gear and its resistance to closure is increased. A spring release means 76 engages and extends longitudinally between the seat means 32 and the center wedge 72 for continuously urging the friction cushioning means 40 outwardly from the compressible cushioning means 26 to release the friction cushioning means 40 when an applied force compressing the draft gear assembly 10 is removed.

Figure 5:
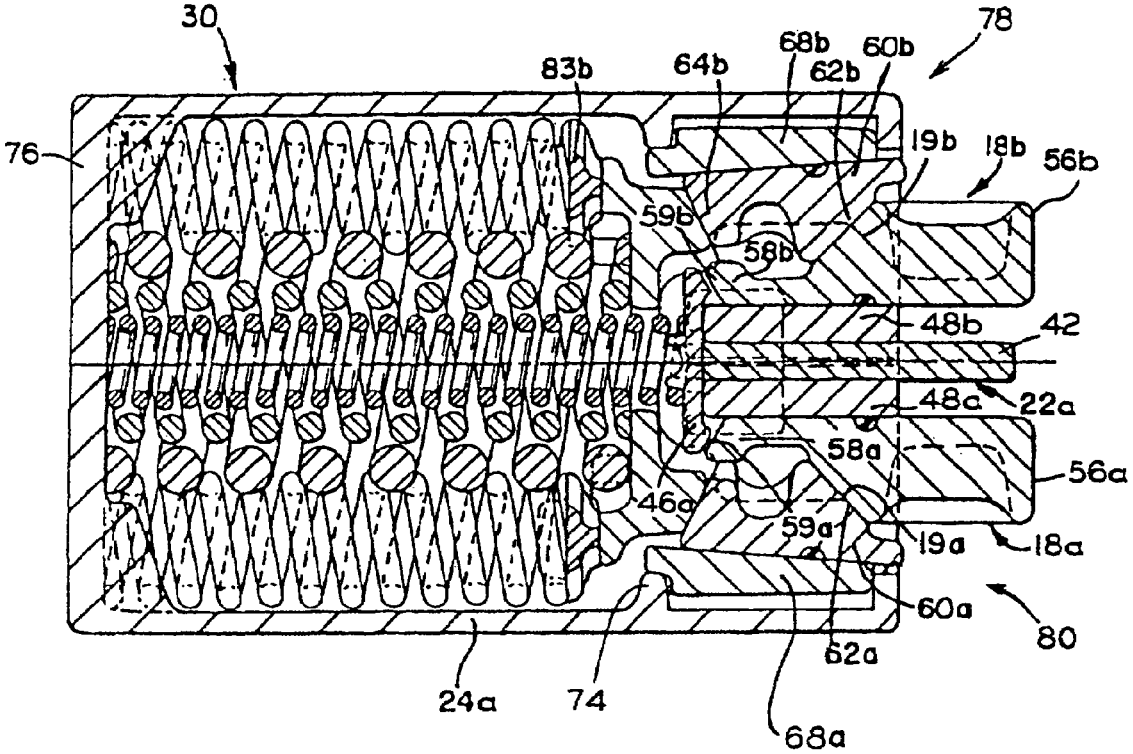
FIG. 5 is a cross-sectional view of a split wedge draft gear with a center friction plate.

The present invention may also be applied to a split wedge type draft gear having a center friction plate such as shown in FIG. 5. This type of draft gear is discussed in detail in U.S. Pat. No. 4,735,328. The disclosure of which is incorporated into the present application by reference thereto.

As shown in FIG. 5, the split wedge draft gear assembly includes a housing 24*a* closed at one end 76 and open at an opposed end, generally indicated as 78. The housing has a rear portion adjacent the closed end and a front portion adjacent the open end. The front portion is in open communication with the rear portion. At least one horizontal rib 74 having a top and bottom surface is provided within the housing 24*a*. A compressible cushioning means, such as a spring system means 30*a*, is centrally disposed within the rear portion with one end thereof abutting at least a portion of an inner surface of the closed end of the housing. The compressible cushioning means extends longitudinally from the one end. A seat means 46*a* is provided having at least a portion of one surface thereof abutting the opposite end of the compressible cushioning means 30*a* during application and release of a force on the draft gear assembly.

Figure 5A:
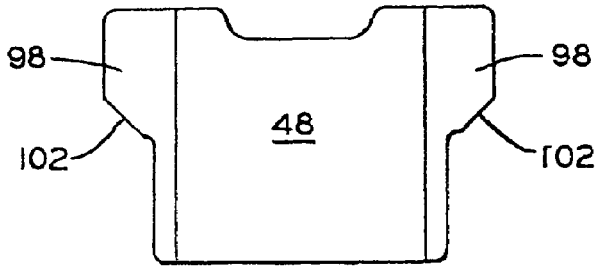
FIG. 5A is a plan view of one of the barrier plates of the friction cushioning means of a split wedge draft gear.

A friction cushioning means, generally indicated as 80 is positioned at least partially within the front portion 78 of the housing for absorbing energy during a compression of the draft gear assembly. The friction cushioning means includes a friction plate means 22*a* centrally disposed within the front portion of the housing. The friction plate means 22*a* has a first end which extends out of the housing 24*a* and a second end which contacts the seat means 46*a*. A first and second barrier plate means 48*a* and 50*a* are disposed one on either side of the friction plate 22*a*. The first and second barrier plate means 48*a*, 48*b* include lugs 98, as shown in FIG. 5A for contacting at least one horizontal rib 74 within the housing for supporting the barrier plate means within the housing. At least a portion of the lugs 98 included an angled portion 102 which comes into contact with a top surface of the at least one supporting rib within the housing so as to increase the side force applied to the friction plate means 22*a* and increase the capacity of the draft gear.

The friction cushioning means further includes first and second friction wedge means 18*a* and 18*b*. The first friction wedge means 18*a* is disposed on one side of the first barrier plate means 48*a* and the second friction wedge means 18*b* is disposed on one side of the second barrier plate means 48*b*. A first and second shoe means 60*a* and 60*b* are provided wherein the first shoe means 60*a* is disposed on one side of the first friction wedge means 48*a* and the second shoe means 60*b* is disposed on one side of the second friction wedge means 48*b*. The friction cushioning means also includes first and second wear liner plate means 68*a* and 68*b*. The first wear liner plate means 68*a* is disposed on one side of the first shoe means 60*a* and the second wear liner plate means 68*b* is disposed on one side of the second shoe means 60*b*. In addition to the angled lug 98 of the barrier plates, at least one horizontal rib contacting the angled portion of the lug can be cooperatively angled.

Thus, the present invention has been described in such full, clear, concise and exact terms as to enable any person skilled in the art to which it pertains to make and use the same. It will be understood that variations, modifications, equivalents, and substitutions for components of the specifically described embodiments of the invention may be made by those skilled in the art without departing from the spirit and scope of the invention as set forth in the appended claims.

I claim:

1. A draft gear assembly to cushion shocks encountered in railroad rolling stock, said draft gear assembly comprising:

(a) a housing closed at one end and open at the opposed end, said housing having a rear portion adjacent said closed end and a front portion adjacent said open end, said front portion being in open communication with said rear portion;

(b) at least one horizontal rib within said housing, said at least one horizontal rib having a top and bottom surface;

(c) at least one of a spring and a hydraulic compressible cushioning element centrally disposed within said rear portion with one end thereof abutting at least a portion of an inner surface of said closed end of said housing, said compressible cushioning element extending longitudinally from said one end;

(d) a positioning means on said inner surface of said closed end of said housing for maintaining said one end of said compressible cushioning element centrally positioned in said rear portion of said housing during compression and extension of said compressible cushioning element;

(e) a seat means having at least a portion of one surface thereof abutting the opposite end of said compressible cushioning element during application and release of a force on said draft gear assembly;

(f) a friction cushioning means positioned at least partially within said front portion of said housing for absorbing energy during a compression of said draft gear assembly, said friction cushioning means including (i) a pair of laterally spaced outer stationary plates having an outer surface for engaging said housing and an opposed inner friction surface, (ii) a pair of laterally spaced movable plates having an outer friction surface and an inner friction surface and at least one substantially flat edge intermediate said outer friction and inner friction surfaces, said one edge engaging said seat means, at least a portion of said outer friction surface movably and frictionally engaging said-inner friction surface of said outer stationary plate, (iii) a pair of laterally spaced tapered plates, said tapered plates having an outer friction and an inner friction surface and a lug which comes into contact with said top surface of said at least one horizontal rib within said housing, at least a portion of said lug contacting said at least one horizontal rib within said housing having a tapered surface, said outer friction surface of said pair of tapered plates movably and frictionally engaging at least a portion of said inner friction surface of said movable plate, (iv) a pair of laterally spaced wedge shoes having at least a portion of an outer friction surface movably and frictionally engaging at least a portion of an inner friction surface or said tapered plate, and at least a portion of one edge engaging said seat means, (v) a center wedge having a pair of matching predetermined tapered portions for engaging said tapered portion of said wedge shoe to initiate frictional engagement of said friction cushioning means and thereby absorb energy; and (g) a spring release means engaging and longitudinally extending between said seat means and said center wedge for continuously urging said friction cushioning means outwardly from said compressible cushioning means to release said friction cushioning element when an applied force compressing said draft gear is removed.

2. A draft gear assembly as recited in claim 1 wherein said at least one horizontal rib contacting said at least a portion of said at least one lug of said tapered plates is angled.

3. A draft gear assembly as recited in claim 2 wherein said housing includes at least a first, second, and third horizontal rib and said tapered surface is on said third horizontal rib.

4. A draft gear assembly having an increased capacity to cushion shocks encountered in railroad rolling stock, said draft gear assembly comprising:

(a) a housing closed at one end and open at the opposed end, said housing having a rear portion adjacent said closed end and a front portion adjacent said open end, said front portion being in open communication with said rear portion;

(b) at least one horizontal rib within said housing, said at least one horizontal rib having a top and bottom surface;

(c) a compressible cushioning element centrally disposed within said rear portion with one end thereof abutting at least a portion of an inner surface of said closed end of said housing, said compressible cushioning element extending longitudinally from said one end;

(d) a seat means having at least a portion of one surface thereof abutting the opposite end of said compressible cushioning element during application and release of a force on said draft gear assembly;

(e) a friction cushioning means positioned at least partially within said front portion of said housing for absorbing energy during a compression of said draft gear assembly, said friction cushioning means including (i) a pair of laterally spaced movable plates having an outer friction surface and an inner friction surface and at least one substantially flat edge intermediate said outer friction and inner friction surfaces, said one edge engaging said seat means, (ii) a pair of laterally spaced tapered plates positioned for frictional engagement with at least a portion of said inner friction surface of said movable plates, said tapered plates having an outer friction and an inner friction surface and at least one lug, at least a portion of said at least one lug having a tapered or angled surface which contacts at least a portion of said top surface of said at least one horizontal rib, so as to increase the side force applied to said movable plates and increase the capacity of the draft gear, (iii) a pair of laterally spaced wedge shoes having at least a portion of an outer friction surface movably and frictionally engaging at least a portion of an inner friction surface of said tapered plate, and at-least a portion of one edge engaging said seat means, and (iv) a center wedge having a pair of matching predetermined tapered portions for engaging said tapered portion of said wedge shoe to initiate frictional engagement of said friction cushioning means and thereby absorb energy to cushion shocks encountered in railroad rolling stock.

5. A draft gear assembly as recited in claim 4 wherein said top surface of said at least one horizontal rib contacting said angled portion of said lug is angled.

6. A draft gear assembly as recited in claim 4 wherein said housing includes at least a first, second, and third horizontal rib and said tapered surface of said lug is positioned adjacent said third horizontal rib.

7. A draft gear assembly having an increased capacity as recited in claim 4 wherein said cushioning means includes a pair of laterally spaced outer stationary plates having an outer surface for engaging said housing and an opposed inner friction surface for engaging said outer friction surface of said movable plates.

8. A draft gear assembly having an increased capacity as recited in claim 4 including a spring release means engaging and longitudinally extending between said seat means and said center wedge for continuously urging said friction cushioning means outwardly from said compressible cushioning means to release said friction cushioning element when an applied force compressing said draft gear is removed.

9. A housing and friction cushioning means arrangement for a draft gear assembly to cushion shocks encountered in railroad rolling stock, said housing and friction cushioning means arrangement comprising:

(a) a housing closed at one end and open at the opposed end, said housing having a rear portion adjacent said closed end and a front portion adjacent said open end, said front portion being in open communication with said rear portion;

(b) at least one horizontal rib within said housing, said at least one horizontal rib having a top and bottom surface;

(c) a pair of laterally spaced outer stationary plates, haying an outer surface for engaging said housing of said draft gear assembly and an opposed inner friction surface;

(d) a pair of laterally spaced movable plates, having an outer friction surface and an inner friction surface, at least a portion of said outer friction surface of each of said movable plates movably and frictionally engaging said inner friction surface of said outer stationary plate;

(e) a pair of laterally spaced tapered plates, said tapered plates having an outer friction and an inner friction surface and at least one lug, at least a portion of said at least one lug having a tapered or angled surface which contacts at least a portion of said top surface of said at least one horizontal rib, said outer friction surface movably and frictionally engaging at least a portion of said inner friction surface of said movable plate;

(f) a pair of laterally spaced wedge shoes having at least a portion of an outer friction surface movably and frictionally engaging at least a portion of an inner friction surface of said tapered plate, and at least a portion of one edge engaging said seat means; and (g) a center wedge having a pair of matching predetermined tapered portions for engaging said tapered portion of said wedge shoe to initiate frictional engagement of said friction cushioning means and thereby absorb energy to cushion shocks encountered in railroad rolling stock.

10. A housing and friction cushioning means arrangement for a draft gear assembly as recited in claim 9 wherein said at least one horizontal rib is angled.

11. A housing and friction cushioning means arrangement for a draft gear assembly as recited in claim 9 wherein said housing includes at least a first, second, and third horizontal rib and said tapered surface of said lug is positioned adjacent said third horizontal rib.

12. A housing and friction cushioning means arrangement for increasing the capacity of a draft gear assembly to cushion shocks encountered in railroad rolling stock, said housing and friction cushioning means arrangement comprising:

(a) a housing closed at one end and open at the opposed end, said housing having a rear portion adjacent said closed end and a front portion adjacent said open end, said front portion being in open communication with said rear portion;

(b) at least one horizontal rib within said housing, said at least one horizontal rib having a top and bottom surface;

(c) a pair of laterally spaced movable plates having an outer friction surface and an inner friction surface;

(d) a pair of laterally spaced tapered plates positioned for frictional engagement with at least a portion of said inner friction surface of said movable plates, said tapered plates having an outer friction and an inner friction surface and at least one lug having a tapered portion and contacting at least a portion of said top surface of said at least one horizontal rib, so as to increase the side force applied to said movable plates and increase the capacity of the draft gear;

(e) a pair of laterally spaced wedge shoes having at least a portion of an outer friction surface movably and frictionally engaging at least a portion of an inner friction surface of said tapered plate, and at least a portion of one edge engaging said seat means; and (f) a center wedge having a pair of matching predetermined tapered portions for engaging said tapered portion of said wedge shoe to initiate frictional engagement of said friction cushioning means and thereby absorb energy to cushion shocks encountered in railroad rolling stock.

13. A friction cushioning means for increasing the capacity of a draft gear assembly as recited in claim 12 wherein said friction cushioning means is positioned in a housing and wherein said housing includes a first, second, and third horizontal rib and said tapered lug of laterally spaced tapered plates is positioned on said third horizontal rib.

14. A housing and friction cushioning means arrangement for a draft gear assembly as recited in claim 12 wherein said at least one horizontal rib is angled.

15. A friction cushioning means for increasing the capacity of a draft gear assembly as recited in claim 12 wherein said cushioning means includes a pair of laterally spaced outer stationary plates having an outer surface for engaging said housing and an opposed inner friction surface for engaging said outer friction surface of said movable plates.

16. A friction cushioning, means for increasing the capacity of a draft gear assembly as recited in claim 12 including a spring release means engaging and longitudinally extending between a seat means and said center wedge for continuously urging said friction cushioning means outwardly from said compressible cushioning means to release said friction cushioning element when an applied force compressing said draft gear is removed.

17. A split wedge draft gear assembly to cushion shocks encountered in railroad rolling stock, said split wedge draft gear assembly comprising:

(a) a housing closed at one end and open at an opposed end, said housing having a rear portion adjacent said closed end and a front portion adjacent said open end, said front portion being in open communication with said rear portion;

(b) at least one horizontal rib within said housing said at least one horizontal rib having a top and bottom surface;

(c) a compressible cushioning means centrally disposed within said rear portion with one end thereof abutting at least a portion of an inner surface of said closed end of said housing, said compressible cushioning means extending longitudinally from said one end;

(d) a seat means having at least a portion of one surface thereof abutting the opposite end of said compressible cushioning means during application and release of a force on said draft gear assembly;

(e) a friction cushioning means positioned at least partially within said front portion of said housing for absorbing energy during a compression of said draft gear assembly, said friction cushioning means including:

(i) a friction plate means centrally disposed within said front portion of said housing, said friction plate means having a first end which extends out of said housing and a second end which contacts said seat means, (ii) first and second barrier plate means disposed one on either side of said friction plate, said first and second barrier plate means including lugs for contacting said at least one horizontal rib within said housing for supporting said plates within said housing, at least a portion of said lugs including an angled portion which comes into contact with a top surface of said at least one supporting rib within said housing so as to increase the side force applied to the said friction plate means and increase the capacity of the draft gear;

(iii) first and second friction wedge means, said first friction wedge means being disposed on one side of said first barrier plate means and said second friction wedge means being disposed on one side of said second barrier plate means;

(iv) first and second shoe means, said first shoe means being disposed on one side of said first friction wedge means and said second shoe means being disposed on one side of said second friction wedge means; and (v) first and second wear liner plate means, said first wear liner plate means being disposed on one side of said first shoe means and said second wear liner plate means being disposed on one side of said second shoe means.

18. A split wedge draft gear assembly as recited in claim 17 wherein said top surface of said at least one horizontal rib contacting said angled portion of said lug is cooperatively angled.

* * * * *